US008336720B2

(12) United States Patent
Potter

(10) Patent No.: US 8,336,720 B2
(45) Date of Patent: Dec. 25, 2012

(54) ILLUSION STORAGE RACK

(76) Inventor: Anthony B Potter, Crozet, VA (US)

( * ) Notice: Subject to any disclaimer, the term of this patent is extended or adjusted under 35 U.S.C. 154(b) by 247 days.

(21) Appl. No.: 12/870,869

(22) Filed: Aug. 30, 2010

(65) Prior Publication Data

US 2011/0049068 A1 Mar. 3, 2011

Related U.S. Application Data

(60) Provisional application No. 61/237,887, filed on Aug. 28, 2009.

(51) Int. Cl.
*A47B 73/00* (2006.01)

(52) U.S. Cl. ..... 211/74

(58) Field of Classification Search ..... 211/74, 211/75, 60.1, 44, 10, 85.18; 472/63, 71; 206/427, 457; 220/676, 668
See application file for complete search history.

(56) References Cited

U.S. PATENT DOCUMENTS

| | | | | | |
|---|---|---|---|---|---|
| 353,554 | A | * | 11/1886 | Godfrey | 211/77 |
| 609,009 | A | | 7/1898 | Carrington | |
| 1,680,855 | A | | 1/1926 | Burns | |
| 1,740,842 | A | | 6/1928 | Steen | |
| 1,721,014 | A | | 7/1929 | Trippe-Furst | |
| 2,103,321 | A | * | 12/1937 | De Deza et al. | 472/58 |
| 2,336,508 | A | * | 12/1943 | Smith et al. | 353/37 |
| 2,338,310 | A | * | 1/1944 | Barnes | 211/74 |
| 2,580,676 | A | * | 1/1952 | Gross | 211/75 |
| 2,622,741 | A | * | 12/1952 | Bamert | 211/74 |
| 2,681,262 | A | * | 6/1954 | Vincent | 312/118 |
| 2,781,072 | A | * | 2/1957 | Kouke | 206/315.6 |
| 3,379,315 | A | * | 4/1968 | Broadwin | 211/72 |
| 3,738,041 | A | * | 6/1973 | Rattner | 40/561 |
| 3,854,590 | A | | 12/1974 | Dolby | |
| 4,023,681 | A | * | 5/1977 | Plant | 211/74 |
| 4,023,794 | A | | 5/1977 | Adams | |
| 4,093,076 | A | * | 6/1978 | Newton | 211/74 |
| 4,270,662 | A | * | 6/1981 | Gonzalez | 211/74 |
| D272,699 | S | * | 2/1984 | Godfrey | D7/701 |
| 4,700,849 | A | * | 10/1987 | Wagner | 211/41.2 |
| 4,960,274 | A | | 10/1990 | Boles | |
| 4,967,953 | A | | 11/1990 | Sugawara | |
| 4,998,631 | A | * | 3/1991 | Fridjhon | 211/74 |
| 5,036,989 | A | * | 8/1991 | Carilli | 211/74 |
| 5,348,220 | A | * | 9/1994 | Setteducati | 232/1 D |
| 5,392,161 | A | | 2/1995 | Weder | |
| 5,494,217 | A | | 2/1996 | Suzuki | |
| 5,617,960 | A | * | 4/1997 | Bishop | 211/60.1 |
| 5,845,776 | A | * | 12/1998 | Galbierz et al. | 206/427 |
| 6,722,510 | B1 | | 4/2004 | Sen | |
| 7,159,735 | B2 | * | 1/2007 | Morse | 220/529 |
| D541,117 | S | * | 4/2007 | Schwartz | D7/701 |
| 7,506,771 | B2 | * | 3/2009 | Bianchini | 211/75 |
| 7,757,868 | B2 | * | 7/2010 | Bianchini | 211/75 |

(Continued)

OTHER PUBLICATIONS

Chain Wine Bolder Holder Illusion: http://www.moillusions.com/2008/01/chain-wine-bottle-holder-illusion.html.

(Continued)

*Primary Examiner* — James O Hansen
*Assistant Examiner* — Kimberley S Wright
(74) *Attorney, Agent, or Firm* — Vance Intellectual Property, PC

(57) ABSTRACT

A storage rack is provided that exhibits an optical illusion that some of the items stored in the rack have disappeared in all or in part.

20 Claims, 2 Drawing Sheets

U.S. PATENT DOCUMENTS

| | | | | |
|---|---|---|---|---|
| 7,922,015 | B2 * | 4/2011 | Bassetti | 211/74 |
| 8,046,941 | B2 * | 11/2011 | Schnuckle | 40/324 |
| 8,061,538 | B2 * | 11/2011 | Seldon | 211/74 |
| 2003/0178381 | A1 * | 9/2003 | Liang | 211/74 |
| 2005/0011843 | A1 * | 1/2005 | Dagan | 211/74 |
| 2007/0017884 | A1 * | 1/2007 | Yang | 211/74 |
| 2007/0062892 | A1 * | 3/2007 | Donnellan | 211/74 |
| 2007/0108145 | A1 * | 5/2007 | Milardo et al. | 211/74 |
| 2007/0210022 | A1 * | 9/2007 | Bianchini | 211/75 |

OTHER PUBLICATIONS

Ruiz, M.J. et. al., Illusions with Plane Mirrors 1987, Apr. 206-12 (http://www.phys.unca.edu/ruiz/publications/1987_illusions.pdf).

* cited by examiner

ILLUSION STORAGE RACK

CROSS-REFERENCE TO RELATED APPLICATIONS

The present application claims priority benefit under 35 U.S.C. §119(e) of U.S. Provisional Patent Application Ser. No. 61/237,887 filed 28 Aug. 2009. The disclosure this application is incorporated herein by reference.

FIELD OF THE INVENTION

The present invention relates to storage racks that provide the illusion of at least part of an item stored being invisible.

BACKGROUND OF THE INVENTION

Wine collecting is widely practiced today and consumers, collectors, retailers and manufacturers need practical and aesthetically pleasing means for storing and displaying their wines. Responding to this public interest, the current market for wine racks is thriving, and there is much to choose from regarding cost, size, stack-ability, practicality and pleasing aesthetics.

U.S. Pat. Nos. 3,854,590 (John Topping Dolby) and 6,722,501 B1 (Ping-Fang Sen) describe wine racks with unusual and pleasing designs to enhance their aesthetic value, but these designs do not employ an optical illusion to further add to their aesthetic, amusement and novelty value.

There is available on the market today a holder for a single bottle of wine (see: http://www.moillusions.com/2008/01/chain-wine-bottle-holder-illusion.html) manufactured by welding a large chain in such a fixed shape as to form a base which supports a portion of the chain which ascends above the support surface and ends with a loop for inserting the neck of a bottle of wine. Because an observer assumes the chain to be flexible, this holder creates the illusion that the bottle and the part of the chain above the support surface are suspended unsupported in space. However, this welded chain bottle holder is not a practical means of storing a bottle of wine, and it can only hold a single bottle. Furthermore, the illusion effect is not particularly puzzling or startling. However, its established presence in the market for wine racks does illustrate the public's interest in startling and unusual means for displaying bottles of wine.

Magicians have long used the principle of mounting mirrors inside boxes, both small and large in size, to hide small objects, parts of human anatomy such as an arm or a head, or even entire people and animals. The principle is very old and even patented for certain specific uses (see Adams, U.S. Pat. No. 4,023,794).

Advertisers have often employed optical illusions that use light reflective surfaces in their displays to attract customers (see William Albert Burns U.S. Pat. No. 1,680,855, A. Trippe-Furst U.S. Pat. No. 1,721,014 and A. G. Steen U.S. Pat. No. 1,740,842).

Manufacturers of toys, games and novelties have employed optical illusions that use light reflective surfaces to enhance the amusement value of their products (see U.S. Pat. No. 4,967,953 Shigeru Sugawara, Suzuki U.S. Pat. No. 5,494,217 and Boles U.S. Pat. No. 4,960,274).

U.S. Pat. No. 5,392,161 employs light reflective surfaces to create a "see through" effect utilizing the reflective principle of a periscope. This "see through" effect differs from the effect of an empty interior space, and it has the limitation that, like a periscope, its virtual images all rely upon multiple reflections in multiple mirrors, None of these aforementioned devices employs mirrors or other light reflective surfaces as part of the design of a rack for storing one or more objects. Furthermore, nothing in the prior art or currently for sale on the market employs the use of an optical illusion created with light reflective surfaces to enhance the novelty, amusement and aesthetic value of racks for the practical display and storage of one or more bottles of wine.

SUMMARY OF THE INVENTION

The present invention provides a novel storage rack for storing items (e.g., wine bottles, writing utensils, and umbrellas), wherein the rack exhibits an optical illusion that the items have vanished in whole or in part.

The present invention also provides a novel method of providing a novel storage rack for storing items, wherein the rack exhibits an optical illusion that the items have vanished in whole or in part.

These and other aspects of the present invention have been accomplished in view of the discovery of a storage rack as described herein.

BRIEF DESCRIPTION OF THE DRAWINGS

In the drawings, closely related figures have the same number but different alphabetical suffixes.

DETAILED DESCRIPTION OF THE INVENTION

Figure 1:
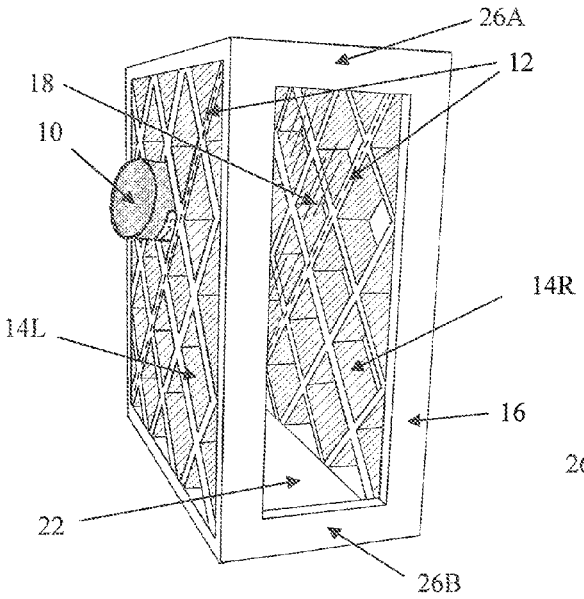
FIG. 1 is a perspective view from the left hand front viewpoint of an illusion wine rack of my invention.

Incorporating an illusion into the design of a storage rack adds novelty, amusement and aesthetic value to a practical means for storing or displaying items. With respect to a wine rack, retail wine sales locations could attract and amuse customers by displaying bottles of their product in a rack of such a design. Because wine varieties are so plentiful in today's crowded and sometimes confusing wine market, displaying wines in a novel and startling manner with such a display can give them a marketing edge. The display and consumption of wines by consumers usually occurs at social occasions, so it is particularly desirable to display wines in a manner that is pleasantly surprising, which stimulates intellectual curiosity and starts conversations. Hosts at a party might use such a rack to entertain guests. Professional and amateur magicians might use it as part of a magical presentation. And owners of this wine rack might enjoy simply looking at it for the sheer pleasure of experiencing the strong visual illusion effect with a device that stores their wine bottles in a practical fashion.

In an aspect of the invention, a method is provided for designing a rack for storing items, which exhibits an optical illusion that the items have vanished in whole or in part.

In another aspect of my invention, a storage rack for storing at least one item is provided, comprising:

a. a frame structure for holding the at least one item, comprising: two opposing and substantially planar sides and at least one connecting member, wherein:
   i. the two opposing sides are fixed in a position substantially parallel to each other by the at least one connecting member;
   ii. the at least one connecting member is approximately perpendicular to the opposing sides; and,
   iii. the opposing sides and at least one connecting member having sufficient symmetry such that at least one plane of symmetry exists between and perpendicular to the opposing sides;
b. at least one pair of apertures through the two opposing sides of the frame sufficiently large to receive at least one of the items to be stored in the storage rack; and,
c. at least one light reflective surface disposed in the at least one plane of symmetry within the frame structure in such an orientation as to:
   i. reflect a portion of the interior of the frame that visually resembles another adjacent portion of the interior of the frame that is hidden by the at least one light reflective surface, and
   ii. hide from view at least part of the one or more items to be stored.

An advantage of the illusion created by my rack is to enhance the novelty, amusement and aesthetic value of the rack.

In another aspect of my invention, the planar sides and apertures form a lattice-type structure.

In another aspect of my invention, the shape of the two opposing sides of the frame structure is a regular polygon. Examples of regular polygons include triangular, substantially square, rectangular, pentagonal, hexagonal, heptagonal, and octagonal.

In another aspect of my invention, the frame, further comprises: at least two panels, all substantially similar in appearance to each other, which extend between the two opposing sides of the frame connecting two or more of the straight edges of the opposing sides.

In another aspect of my invention, the shape of the two opposing sides of the frame structure is circular or an irregular but substantially symmetrical curve. In another aspect the frame, further comprises: at least one curved panel whose curve conforms to the shape of the circumferences of the two opposing sides, and which extend between the two opposing sides along predetermined portions of the circumference of the side of the frame structure.

In another aspect of my invention, the apertures are sufficient to store an item selected from: bottles (e.g., wine bottles and water bottles), jars, cans, writing utensils (e.g., pens and pencils), measuring instruments (e.g., rulers), office instruments (e.g., scissors and letter openers), and umbrellas.

Examples of the width of the rack (i.e., the length of the at least one connecting member) include widths narrower than the length of the item to be stored and at least as wide as the length of the item to be stored.

The storage rack as described above can be free standing or capable of being mounted on a vertical surface (e.g., a wall). In another aspect of my invention, the frame structure further comprises: at least one leg attached to the frame structure. Additional examples include racks further comprising: at least two legs; at least three legs; at least three legs, wherein the frame is fully supported by the at least three legs; or four legs, wherein the frame structure is fully supported by the four legs. The legs can be present in a number of locations including the frame structure, the opposing sides, the panels (if present), and combinations thereof. When the legs are perpendicular to the apertures, they can be present on the frame and/or the panels. The perpendicular location allows for storage of items substantially parallel to the horizon (e.g., wine bottle storage on a counter top, table, or bookshelf wherein the wine is substantially parallel to the horizon), though when storing non-symmetrical items, the items' shape will determine its exact position in the rack. When the legs are parallel, they can be present on the frame and/or the opposing sides. The parallel location allows for storage of items substantially perpendicular to the horizon (e.g., pencil storage perpendicular to a desktop on which an appropriately sized rack rests).

My invention includes numerous variations with respect to the size of the rack and its components. For example, if it is desirable to store a bottle of wine, the frame structure can be proportioned with appropriate height and width and the apertures appropriately sized to receive a bottle of wine. In another example, if it is desirable to store writing utensils, the frame structure can proportioned to rest on a desktop or tabletop with appropriate height and width and the apertures appropriately sized to receive items include pencils and pens.

In another aspect of my invention, the frame structure can be fabricated with at least one material selected from: wood, fabric, leather, metal, glass, and a polymeric substance. In other aspects, the glass or plastic can be clear or translucent. In other aspects, the appearance of the frame structure modified to suit certain applications, for example, it can be stained, oiled, varnished, painted, sealed, and/or colored (e.g., colored plastic or glass).

In another aspect of my invention, the light reflective surface is reflective on both of its sides. A benefit of this aspect is that it can enhance the illusion even when the rack is viewed from behind the light reflective surface.

In another aspect of my invention, a rack is provided wherein: (a) the shape of the two opposing sides of the frame structure is a regular polygon; (b) the frame structure is fabricated from wood; and, (c) the apertures and at least one connecting member are sufficient to store a wine bottle. In an example of this aspect, the shape of the two opposing sides of the frame structure can be square or rectangular and the width of the rack can be narrower than a bottle of wine, whereby the top and bottom of the wine bottle being stored can extend beyond the width of the rack.

In another aspect of my invention, a method of enhancing the novelty, amusement, and/or aesthetic value of a storage rack by creating the illusion of empty space where one or more items on display reside is provided, comprising:

a. providing a frame structure for holding the at least one item, comprising: two opposing and substantially planar sides and at least one connecting member, wherein:
   i. the two opposing sides are fixed in a position substantially parallel to each other by the at least one connecting member;
   ii. the at least one connecting member is approximately perpendicular to the opposing sides; and,
   iii. the opposing sides and at least one connecting member having sufficient symmetry such that at least one plane of symmetry exists between and perpendicular to the opposing sides;
b. providing at least one pair of apertures through the two opposing sides of the frame sufficiently large to receive at least one of the items to be stored in the storage rack; and,
c. providing at least one light reflective surface disposed in the at least one plane of symmetry within the frame structure in such an orientation as to:

i. reflect a portion of the interior of the frame that visually resembles another adjacent portion of the interior of the frame that is hidden by the at least one light reflective surface, and ii. hide from view at least part of the one or more items to be stored.

In another aspect of my invention, the method further comprises:

d. disposing at least one item in the storage rack.

Figure 2:
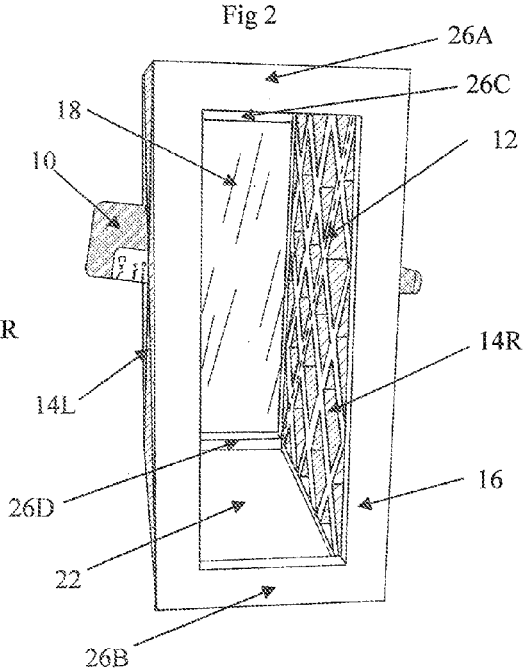
FIG. 2 is a perspective view from the front viewpoint of an illusion wine rack of my invention.
Figure 3:
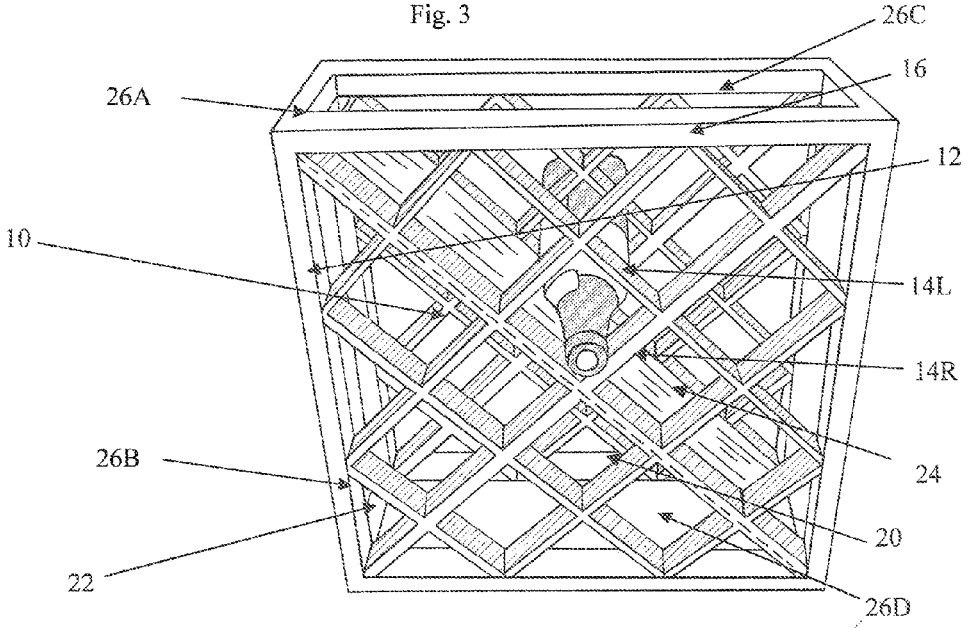
FIG. 3 is a perspective view from the right hand side from slightly above of an illusion wine rack of my invention, clearly showing the back of the light reflective surface and the position of the bottle.

Certain aspects of the present invention are depicted in FIG. 1, FIG. 2, and FIG. 3. These figures show a rectangular frame structure 16 with two opposing sides 14L and 14R that are fixed in position by four connecting members 26A, 26B, 26C and 26D. The opposing sides are square frames that surround lattices 14L and 14R of slats with apertures sufficiently large to permit the passage of an item (e.g., wine bottle) 10 through them. The frame members can be connected using any of several standard joinery techniques. A useful material for the rack described above is wood, though as noted below, other materials can be used for the rack or components thereof.

Between the two framed lattice sides resides a light reflective surface 18 two of whose edges 12 reside at a 45 degree angle to vertical, bisecting the interior space of the frame and positioned so as to hide, to a viewer looking into the front of the rack, the half of the space within the frame which resides behind the light reflective surface. The light reflective surface 18 can be fixed in place by standard techniques, which include using glue or by fashioning grooves in the two framed lattice sides to receive and support the edges 12 of the light reflective surface. Symmetry of the design of the lattices 14L and 14R and the frame 16 assures that the reflected image in the light reflective surface substantially matches what the empty space behind would look like were the light reflective surface absent. When present, a first panel 22 and a second panel 24, similar in size and appearance, enhance the effect because the reflected image of the bottom panel in the light reflective surface appears to be the first panel when, in fact, the first panel is hidden from view behind the light reflective surface.

The item (e.g., wine bottle) 10 rests in a pair of apertures through the lattice sides 14L and 14R for display or storage. As shown in FIG. 2, an item (e.g., a bottle) inserted into the frame through pairs of apertures in the lattices 14L and 14R that are aligned behind the light reflective surface 18 seems to disappear as it is inserted, and to reappear again as the end of the bottle emerges out the other side of the frame structure. The side view in FIG. 3 clearly shows the back of the light reflective surface 20 thereby making clear the exact location of the light reflective surface relative to the lattice sides 14L and 14R of the frame structure 16 and the item 10.

Figure 4:
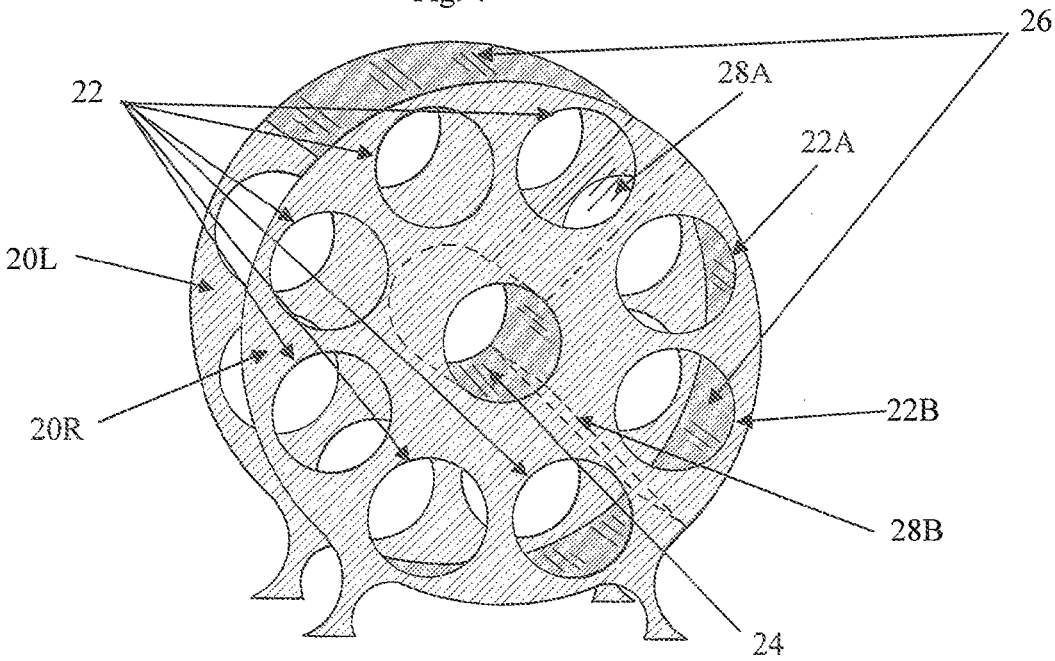
FIG. 4 is another embodiment of an illusion wine rack of my invention using a circular frame, perforated solid panels for the sides of the rack, and a different light reflective surface configuration.

FIG. 4 shows another aspect of the invention, wherein the frame structure comprises circular solid panel sides 20L and 20R with circular apertures 22 through them. The panels are connected by a tubular connecting member 24. Two light reflective surfaces 28A and 28B are positioned so that items inserted into apertures 22A or 22B will appear to vanish to a viewer looking into the rack from the front. A curved panel 26 which partially encloses approximately ¾ of the circumference of the two panel sides 20L and 20R enhances the effect because the portions of the panel reflected by the light reflective surfaces substantially match the portions of the panel that would be visible were the light reflective surfaces absent. Materials used to construct this aspect and other aspects can be opaque or translucent, though a translucent material can enhance the illusion.

Figure 5:
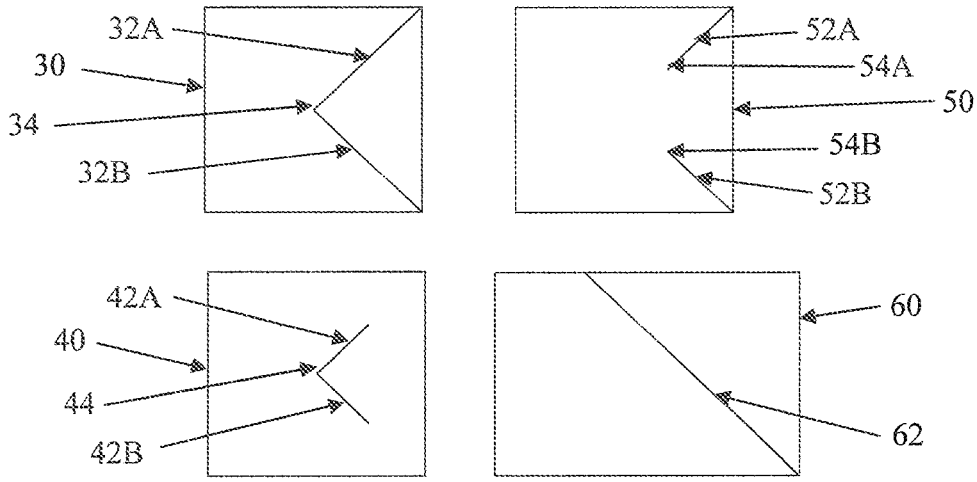
FIG. 5 presents side views of various possible light reflective surface configurations in rectangular shaped illusion wine racks of my invention.

FIG. 5 presents side views of various configurations of the placement of light reflective surfaces 32A, 32B, 42A, 42B, 52A, 52B and 62 within rectangular shaped rack frame structures 30, 40, 50 and 60. In these examples, joints where the light reflective surfaces meet 34 and 44 or edges 54A and 54B of light reflective surfaces exposed in the middle of the rack can be hidden by connecting members (e.g., thin rods) extending between the two sides of the frame structure. What these configurations all have in common is that shape of the frame and the position of each light reflective surface within each frame assures that the reflected images in the light reflective surfaces substantially match what the empty space behind would look like were the light reflective surfaces absent. These configurations of light reflective surface placement represent, without limitation, other possible aspects of the invention.

For maximum visual effect, if on display without any performance of presentation, the rack can be displayed with items placed only in the apertures behind the light reflective surface. This highlights the effect of the invisible portion of those bottles. Alternatively, if one or more items are stored in apertures in front of the light reflective surface, it is best if items are also stored in the apertures behind the light reflective surface that match the virtual position of the reflection of the item inserted in front of the light reflective surface. This assures that all items visible inside the rack, both real and reflected images, match up with the items ends visible on either side outside of the rack. Additional items can then be positioned behind the light reflective surface to display the illusion effect.

It is an especially surprising and startling effect to visibly insert an item (e.g., a wine bottle) through a pair of apertures behind the light reflective surface while an observer is watching from in front of the rack. The item appears to vanish and then reappear as it emerges from outside the other side of the rack.

If two identical items are inserted simultaneously into the rack, one in front of the light reflective surface and one behind through the pair of apertures that matches the virtual position of the reflection of the item inserted in front of the light reflective surface, a very strong and convincing illusion is created that one can see both items at all times. This maneuver may be incorporated into a presentation scenario to strengthen the impression that the entire inside space of the rack is visible at all times.

If the rack is sufficiently wide to completely hide an item from view when it is stored in a pair of apertures, it is possible, using a removable door or cloth on the front of the rack that temporarily hides the inside of the rack from view, to create the effect of changing one item into another. For example, one might present the effect of changing a bottle of red wine into a bottle of white wine.

When panels are not present in my invention, then it is desirable to place the rack in an environment, such as on a bookcase, where the surface below the rack substantially matches the surface behind the rack thereby assuring that the reflection of the surface below on the light reflective surface appears to be the surface behind the rack. The illusion for this variation can be further enhanced if the frame is mounted on legs and positioned at a distance from the surface behind the rack which matches the length of the legs.

Other variations on my invention are included in my invention. These variations include, but are not limited to the following.

A frame structure, or rack, with apertures in the sides enlarged sufficiently to receive more than one item (e.g., bottle or jar).

A rack in which the light reflective surface or surfaces are hinged so that they can be moved out of position thereby hiding the effect until desired.

A rack in which the light reflective surface or surfaces can be easily removed so that the rack can be closely inspected without revealing the method of its creating the optical illusion effect.

A rack which has a removable door or cloth which covers the opening on the front to hide the inside of the rack when desired thereby permitting more dramatic effect when displaying the illusion A rack whose apertures on either side are holes cut into a solid panel A rack with two or more light reflective surfaces positioned in any one of various configurations to hide one or more spaces within the rack A rack wherein one opposing side is the top of the rack and the other opposing side is closed off as a solid bottom Numerous modifications and variations of the present invention are possible in light of the above teachings. It is therefore to be understood that within the scope of the appended claims, the invention may be practiced otherwise than as specifically described herein.

What is claimed is:

1. A storage rack for storing at least one item, comprising:

a. a frame structure for holding the at least one item, comprising: a front and two opposing and substantially planar sides and at least one connecting member, and an interior defined therebetween, wherein:

i. the two opposing sides are fixed in a position substantially parallel to each other by the at least one connecting member;

ii. the at least one connecting member is approximately perpendicular to the opposing sides; and, iii. the opposing sides and at least one connecting member having sufficient symmetry such that at least one plane of symmetry exists between and perpendicular to the opposing sides;

b. at least first and second pairs of apertures extending through the two opposing sides of the frame sufficiently large to receive at least one of the items to be stored in the storage rack; and, c. at least one light reflective surface disposed in the at least one plane of symmetry within the frame structure in such an orientation as to:

i. reflect a portion of the interior of the frame that visually resembles another adjacent portion of the interior of the frame that is hidden by the at least one light reflective surface, and ii. hide from view at least part of the one or more items to be stored;

wherein the first and second pairs of apertures are symmetrically positioned on opposite sides of the light reflective surface, such that when the item is placed into one of the apertures on one side of the frame structure, behind the light reflective surface, and into another one of the apertures on the opposing side of the frame structure, all or part of the item stored in the apertures is hidden from view, when viewed from the front, by the at least one light reflective surface.

2. The rack of claim 1, wherein the planar sides and apertures form a lattice-type structure.

3. The rack of claim 1, wherein the shape of the two opposing sides of the frame structure is a regular polygon.

4. The rack of claim 3, wherein the regular polygon is selected from: triangular, substantially square, rectangular, pentagonal, hexagonal, heptagonal, and octagonal.

5. The rack of claim 3, wherein the frame, further comprises: at least first and second panels, all substantially similar in appearance to each other, which extend between the two opposing sides of the frame connecting two or more of the straight edges of the opposing sides, the first panel being positioned such that its reflection in the light reflective surface appears to the observer to be the second panel.

6. The rack of claim 1, wherein the shape of the two opposing sides of the frame structure is circular or an irregular but substantially symmetrical curve.

7. The rack of claim 6, wherein the frame, further comprises: at least one curved panel whose curve conforms to the shape of the circumferences of the two opposing sides, and which extend between the two opposing sides along predetermined portions of the circumference of the side of the frame structure, the curved panel being positioned such that the reflection in the light reflective surface of at least part of the curved panel appears to the observer to be a different part of the curved panel.

8. The rack of claim 1, wherein the apertures are sufficient to store an item selected from: bottles, jars, cans, writing utensils, measuring instruments, office instruments, and umbrellas.

9. The rack of claim 8, wherein the apertures and at least one connecting member are sufficient to store a wine bottle.

10. The rack of claim 8, wherein the apertures and at least one connecting member are sufficient to store writing utensils.

11. The rack of claim 1, wherein the width of the rack is narrower than the length of the item to be stored.

12. The rack of claim 11, wherein the width of the rack is at least as wide as the length of the item to be stored.

13. The rack of claim 1, wherein the frame structure further comprises: at least one leg attached to the frame structure.

14. The rack of claim 1, wherein the frame structure is capable of being mounted on a vertical surface.

15. The rack of claim 1, wherein the size of the frame structure is proportioned to rest on a desktop or tabletop.

16. The rack of claim 1, wherein the frame structure is fabricated with at least one material selected from: wood, fabric, leather, metal, glass, and a polymeric substance.

17. The rack of claim 1, wherein the light reflective surface is reflective on both of its sides.

18. The rack of claim 1, wherein: (a) the shape of the two opposing sides of the frame structure is a regular polygon; (b) the frame structure is fabricated from wood; and, (c) the apertures and at least one connecting member are sufficient to store a wine bottle.

19. The rack of claim 18, wherein: the shape of the two opposing sides of the frame structure is square or rectangular and the width of the rack is narrower than a bottle of wine, whereby the top and bottom of the wine bottle being stored can extend beyond the width of the rack.

20. A method of assembling an illusionary storage rack by creating the illusion of empty space where one or more items on display reside, comprising:

a. providing a frame structure for holding the at least one item, comprising: a front and two opposing and substantially planar sides and at least one connecting member, and an interior defined therebetween, wherein:

i. the two opposing sides are fixed in a position substantially parallel to each other by the at least one connecting member;

ii. the at least one connecting member is approximately perpendicular to the opposing sides; and, iii. the opposing sides and at least one connecting member having sufficient symmetry such that at least one plane of symmetry exists between and perpendicular to the opposing sides;

b. providing at least first and second pairs of apertures extending through the two opposing sides of the frame sufficiently large to receive at least one of the items to be stored in the storage rack; and, c. providing at least one light reflective surface disposed in the at least one plane of symmetry within the frame structure in such an orientation as to:

i. reflect a portion of the interior of the frame that visually resembles another adjacent portion of the interior of the frame that is hidden by the at least one light reflective surface, and ii. hide from view at least part of the one or more items to be stored;

wherein the at least first and second pairs of apertures are symmetrically positioned on opposite sides of the at least one light reflective surface, such that when the item is placed into one of the apertures on one side of the frame structure, behind the light reflective surface, and into another one of the apertures on the opposing side of the frame structure, all or part of the item stored in the apertures is hidden from view, when viewed from the front, by the at least one light reflective surface.

* * * * *